US006261683B1

(12) United States Patent
Tanaka

(10) Patent No.: US 6,261,683 B1
(45) Date of Patent: Jul. 17, 2001

(54) SHIELDING TAPE AND SHIELDING WIRE USING THE SAME

(75) Inventor: Atsuo Tanaka, Nagoya (JP)

(73) Assignees: Harness System Technologies Research, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/339,841

(22) Filed: Jun. 25, 1999

(30) Foreign Application Priority Data

Jun. 29, 1998 (JP) ..... 10-182889
Jun. 29, 1998 (JP) ..... 10-182890
Apr. 21, 1999 (JP) ..... 11-114123

(51) Int. Cl.[7] ..... H01B 7/08

(52) U.S. Cl. ..... 428/344; 428/354; 428/377; 428/379; 174/117 A; 174/107; 174/117 F

(58) Field of Search ..... 428/343, 344, 428/354, 377, 379, 461; 174/107, 117 A, 117 F

(56) References Cited

U.S. PATENT DOCUMENTS 4,449,014 * 5/1984 Brezinsky ..... 174/107
4,596,897 * 6/1986 Gruhn ..... 174/36
4,737,598 * 4/1988 O'Connor ..... 174/36
5,008,489 4/1991 Weeks, Jr. et al. .
5,023,395 * 6/1991 O'Connor ..... 174/36

FOREIGN PATENT DOCUMENTS 0 057 994 A2 8/1982 (EP) .
0 141 231 A2 5/1985 (EP) .
4-133319 U 12/1992 (JP) .

* cited by examiner

*Primary Examiner*—Daniel Zirker
(74) *Attorney, Agent, or Firm*—Oliff & Berridge, PLC

(57) ABSTRACT

A shielding tape, wherein a shielding layer is laminated on one side with an adhesive agent layer for a core for adhering an insulation shielding material of a core wire, and laminated on the other side with a reinforcing seat layer, and laminated with an adhesive agent layer for a sheath for adhering the sheath on the reinforcing seat layer, is characterized in that adhesive strength of the adhesive agent layer for the core to the insulation shielding material is smaller than adhesive strength between the respective layers. Preferably, the shielding materials and the sheath are composed of a non-halogen material, the adhesive agent for core and the adhesive agent for sheath are composed of the non-halogen material, and adhesive force of the adhesive agent for core to the insulating material is smaller than adhesive force of the adhesive agent for sheath to the sheath.

14 Claims, 4 Drawing Sheets

SHIELDING TAPE AND SHIELDING WIRE USING THE SAME

BACKGROUND OF THE INVENTION

1. Field of Invention

This invention relates to a shielding wire for electronic equipment such as copiers, facsimile machines, audio devices, such as tape recorders, and the like, and further for automobiles. The present invention also relates to a shielding tape to be used with a shielding wire, wherein the shielding wire is a flat cable type wire that can improve productivity, without adversely affecting processing terminals of the shielding wire, and can provide excellent shielding of electromagnetic noise. The present invention is also directed to shielding wires using such a shielding tape. Further, this invention also relates to a shielding wire composed of an environmentally-friendly, non-halogen-containing material that does not pollute the environment and does not adversely affect the shielding or production of the wire.

2. Description of Related Art

Flat cable type shielding wires, as shown in FIG. 1, have been used as a shielding wires for electronic equipment including, but not limited to, copiers, facsimile machines and audio equipment.

In flat cable type shielding wires, core wires 3, 3 are formed integrally by wrapping lead wires 1 with insulation sheathing materials 2 (generally polyvinyl chloride) and drain wire 4, arranged in parallel with fixed distances. Also, a shielding tape 5 is adhered closely on the outer peripheries of the core wires 3, 3 and the drain wire 4, while shielding tape 5 is adhered to form bridging parts 7, 7' for maintaining fixed distances. The shielding tape 5 is further protected with sheaths 6 (generally polyvinyl chloride). In the above-described shielding wire, the insulation shielding material 2 and the sheath 6 generally exhibit excellent thermal resistance, insulation and flexibility. In addition, because the shielding material 2 and the sheath 6 are made of polyvinyl chloride, the shielding material 2 and the sheath 6 are relatively inexpensive.

The shielding tape, shown in FIG. 2A, comprises a shielding layer 11, a reinforcing seat layer 12, laminated on the side of a sheath 6 of the shielding layer 11, a sheath adhesive agent layer 13, for adhering the reinforcing seat layer 12 and the sheath, and a core adhesive agent layer 14, for adhering the shielding layer 11 and the core wire 3. The shielding layer 11 is generally composed of a combination of a metal foil 11*a* of high electric conductivity, such as copper or aluminum, and a metal foil 11*b* of high permeability, such as iron or tin. Since the reinforcing seat layer 12 exhibits insufficient strength when combined only with the shielding layer 11 composed of the metal foil, the reinforcing seat layer is ordinarily laminated with a polyester in order to increase strength without substantially increasing cost. Although, laminated shielding tapes are preferred, the present invention may also be directed to shielding tapes that are not laminated with a polyester reinforcing seat layer. Generally, the sheath adhesive agent layer 13, includes adhesive agents of the polyethylene terephthalate group (hereafter referred to as "PET"). In addition, the core adhesive agent layer 14, generally includes adhesive agents of a copolymer of vinyl chloride and vinyl acetate (hereafter briefly called a "vinyl chloride-vinyl acetate copolymer").

The core adhesive agent layer 14 is, as shown in FIG. 2B, formed by coating the core adhesive agent in oblique stripes on one side of the shielding layer 11. That is, pails 14*a*, to be coated with the core adhesive agent, and parts 14*b*, not to be coated, are alternately arranged in a lengthwise direction of the tape, and in the non coating parts 14*b*, the metal foils composing the shielding layer 11 are exposed. Thus, via the non-coating parts 14*b*, the drain wire 4 and the metal foil composing the shielding layer 11 are directly contacted to provide electric conductivity. The shielding tape 5 is thereby grounded to shield electromagnetic waves inside and outside of the cable that can cause strains of signals or noises. On the other hand, by adhesion of the coating part 14*a* of the core adhesive agent layer 14, the shielding tape 5 closely adheres to the core wire 3 to prevent the core wire 3 from slipping out, and to form bridges 7, 7' between the core wires 3 and 3 as well as between the core wire 3 and the drain wire 4 to prevent misregistration of the core wire 3.

With respect to processing at a terminal of a flat cable type shielding wire having the above-structure, an outermost diameter of the portion of the drain wire 4 (outer diameter shielded with the shielding tape 5 and the sheath 6) is made equal to the outer diameter of the core wire 3, and the terminal is processed using a pressure connection system. The pressure connection system is, as shown in FIG. 3, operates so that the sheath 6 and the shielding tape 5, shielding the core wires 3, are scaled off to expose the core wires 3 and so that a portion of the drain wire 4 is covered with the shielding tape 5 and the sheath 6. Then, under these conditions, contact pins 20 are inserted.

The insertion of the contact pin 20 is performed so that connecting terminals (not shown) having a number of connecting contact pins 20, as shown in FIG. 4A, corresponding to a total number of the core wires 3 and the drain wires 4, are inserted with the exposed core wires 3 (FIG. 4B). In addition, the core wires 3 are pushed so that the contact pins 20 contact the conductors 1 (FIG. 4C), and are further forced into the conductors 1 (FIG. 4D), so that the conductors 1 break through the insulation shielding materials 2 and contact the contact pins 20. In a case of the drain wire 4, the contact pin 20 breaks through the shielding tape 5 and sheath 6, and contacts the drain wire 4.

In such a connection system, by maintaining a fixed pitch between the contact pins 20, 20, a pitch between the core wires 3, 3 and a pitch between the core 3 and the drain wire 4, it is possible to automatically cut the shielding wires, exfoliate the shielding tape 5 and the sheath 6, and automatically attach the connecting terminals by pressure.

Therefore, to accurately connect the conductors 1 of the plurality of core wires 3 in the shielding wires and the contact pins 20 in a bundle, it is necessary to fix the pitch between the core wires 3, 3 and the pitch between the core wires 3 and the drain wire 4 in response to the pitch between the pins 20, 20. For this, the shielding tape 5 should be close to the core wire 3 and the drain wire 4 so as to prevent the core wire from misregistration even after scaling off the shielding tape 5 and the sheath 6.

On the other hand, if the adherence between the shielding tape 5 and the core wire 3 is too great, when exfoliating the sheath 6 and the shielding tape 5 from the terminal of cut face, only the sheath 6 is removed, and the shielding tape 5 remains adhered to the core wire 3. If the shielding tape 5 adheres to the core wire 3, the contact pin 20 and the shielding layer 11 of the shielding tape 5 will likely come in contact, and will result in undesirable contact shorts to the drain wire 4 via the shielding layer 11.

In order to solve these problems, manufacturers have developed shielding wires, wherein the exfoliation of shielding tape is made easier to prevent contact shorts that can occur during processing at the terminals. For example, JP-A-4-133319U gazette discloses a shielding wire wherein a core wire is shielded on its outer periphery with a tape coiled layer coated with a mold releasing agent. Thus, the shielding wire of JP '319 is covered with a shielding tape via a tape coiled layer. By shielding the wire using a tape coiled layer, the shielding tape is easily released from the core wire, between core wires, and between a core wire and a drain wire. Accordingly, the core wire can be prevented from misregistration by the close mutual adherence of shielding tapes. However, in order to shield a wire according to the process of JP '319, an additional step of forming a tape-coiled layer is required. Because JP '319 requires an additional step in the manufacturing process, the overall cost of production is substantially increased.

On the other hand, in order to facilitate exfoliation, manufacturers have proposed making the areas of the coating parts 14*a* of the core adhesive agent layers 14 smaller. Unfortunately, making the area of the coating part 14*b* smaller ends up decreasing the adhesive force between the core wire 3 and the shielding tape 5. In addition, the adhesive force between the mutual shielding tapes at the bridge parts 7, 7' is reduced, causing the core wire 3 to experience misregistration and slipping. As a result, this approach is not always a suitable solution.

In conventional shielding tapes, areas connecting between mutual coating parts 14*a* are made larger than areas between the coating parts 14*a* and the non coating parts 14*b* of the core adhesive agent of the shielding tape 5 in the bridge parts 7, 7'. This is done to strengthen fixing of positions of the core wires 3. For this purpose, an area of the coating part 14*a* is made larger than that of the non coating parts 14*b*. In short, a width (W1) of the coating part 14*a* is set to be larger than a width (W2) of the non coating part 14*b*. Actually, a width (W1) of the coating part 14*a* is around 2 mm and a width (W2) of the non-coating part 14*b* is around 1 mm.

As shielding wires for automobiles, collective strands of core wires and drain wires are cylindrically covered with shielding tape. However, because flat cable type wires are capable of omitting a bundle of wires during production and reducing the number of steps needed for processing of shielding wire terminals, manufacturers have considered using flat cable type wires that are similar to public welfare shielding wires used in, for example, audio and electronic equipment. If automobile shielding wires are made using flat cable type wires, flat cable type shielding wires produced for public welfare may be employed. The use of such wires makes it possible to centralize production lines, thereby reducing overall production cost.

However, the recent development of automobile electronics has created an increased demand for more intensive shielding properties. Because modern automotive electrical systems require additional shielding, the flat cable type shielding wires currently available for public welfare cannot be used.

When polymers containing halogen and polyvinyl chloride are exposed to high temperatures (e.g. 80 to 120° C.), poisonous gases, including hydrohalogen gas, are produced.

In order to minimize potential environmental hazards, manufacturers have considered using non-halogen materials, such as polyolefin group polymers, as materials used to make the sheath and the insulation shielding material used in shielding wires. However, when materials of the polyolefin group are used to make the sheath and the insulation shielding material in flat cable typed shielding wires, the balance of the adhesive force of the shielding tape to the sheath and the insulation shielding material is broken. Thus, the likelihood of the resulting wire being an inferior product is substantially increased.

Adhesive agents of the PET group generally used as the sheath adhesive agent do not adhere strongly to adhesive agents of polyolefin group. As a result, only the sheath is scaled off during exfoliation, and shielding tape remains adhered to the surface of the core wire.

In addition, adhesive agents of the vinyl chloride-vinyl acetate group may generate poisonous gases, such as polyvinyl chloride, that cause environmental pollution. Accordingly, there is a need for non-halogen materials that can be used in place of environmentally hazardous adhesive agents.

SUMMARY OF THE INVENTION

The invention has been realized in view of the above circumstances, and it is an object of the present invention to provide a shielding tape that minimizes these disadvantages and substantially avoids the problems commonly experienced during terminal processing. Another object of the present invention is to provide a tape that increases product yield by being able to adhere more closely to the core wire. The present invention also aims to offer shielding tapes that exhibit superior shielding characteristics and are capable of being applied to both automobile shielding wires as well as flat cable type shielding wires. Further, the shielding wire of the present invention uses non-halogen materials to reduce the risks of environmental pollution while providing shielding and terminal processability properties that are equivalent to shielding and processability properties of conventional, environmentally hazardous materials.

Namely, the shielding tape of the present invention is a shielding layer that is laminated on one side and has an adhesive agent layer as a core upon which insulation shielding material of a core wire can be adhered. In addition, the other side of the tape is laminated with a reinforcing seat layer, and laminated with an adhesive agent layer for adhering a sheath on the reinforcing seat layer, wherein an adhesive force between the core adhesive agent layer and the insulation shielding material is smaller than an adhesive force between the respective layers.

The core adhesive agent layer comprises coating parts and non coating parts of core adhesive agent. Preferably, the adhesive strength of the core adhesive agent applied to the coating part and to the insulation shielding material is less than the adhesive strength of a sheath adhesive agent applied to the sheath adhesive agent layer and to the sheath. Further, it is preferable that the adhesion between the sheath adhesive agent and the reinforcing seating layer is greater than strength of the adhesion between the core adhesive agent and the insulation shielding material. In particular, it is preferable that the core adhesive agent is an agent from the polyethylene terephthalate group and that the sheath adhesive agent is an agent from the vinyl chloride-vinyl acetate copolymer group.

It is preferable that the coating parts and the non coating parts are disposed alternately in a lengthwise direction of the tape, that the width of the coating part and the width of the non coating part are equal, and that the width of the coating part is 1 to 2 mm.

It is also preferable that the shielding tape is interposed in parallel between a plurality of core wires in flat cable type shielding wires disposed in fixed distances with the core wires and the sheath wrapping the core wires in a bundle.

In the flat cable type shielding wire of the present invention a plurality of core wires are disposed in parallel at fixed distances and a shielding tape is furnished to maintain the fixed distances, adhering to shield the core wires in a bundle. In addition, the shielding tape is protected on an outer surface with the sheath. The shielding wire of the present invention is characterized in that the shielding tape is protected on an outer surface with a sheath, and the shielding tape of the invention is employed as the shielding tape.

It is preferable that a difference (|SPc−Spz|) between an SP value (SPc) of the core adhesive agent and an SP value (SPz) of an insulation shielding material is greater than a difference (|SPs−SPt|) between an SP value (SPS) of the sheath adhesive agent for sheath and an SP value (SPt) of the sheath. The above relationship is especially preferred wherein the insulation shielding material and the sheath are polyvinyl chloride.

In the instant description, the term "adhesive force" refers to the strength of exfoliation resistance. The adhesive force depends not only on the kinds of adhesive agents and opponent materials used, but also on the coating areas. More specifically, the term "adhesive strength" refers to the strength of exfoliation resistance exhibited by an adhesive agent applied to a certain coating area, wherein the strength of the resistance depends upon the specific kinds of the adhesive agents and the opponent material used.

In a shielding wire of present the invention, core wires composed of shielding conductors with insulating materials are arranged in parallel with fixed distances. In addition, core wires are stuck on outer peripheries with a shielding tape by an adhesive agent that maintains the fixed distances. The shielding tape is stuck on an outer periphery with an adhesive agent so that a sheath can be adhered to the adhesive agent. The shielding wire is a flat cable type wire, wherein the shielding materials and the sheath are composed of a non-halogen material. The adhesive agent for the core and the adhesive agent for the sheath are composed of the non-halogen material. In addition, an adhesive force of the adhesive agent for adhering insulating materials to the core is less than an adhesive force of the adhesive agent for adhering the sheath to the insulating materials.

It is preferable that the insulating material and the sheath be composed of a material of the polyolefin group, and that the adhesive agent for the sheath be composed of a material of the polyolefin group. It is preferable that the adhesive agent of polyethyleneterephthalate group be used as the adhesive agent for the core. The shielding wire of the invention is suitably served in atmosphere at temperature of 120° C. or less.

DETAILED DESCRIPTION OF THE PREFERRED EMBODIMENTS

First Embodiment

Figure 1:
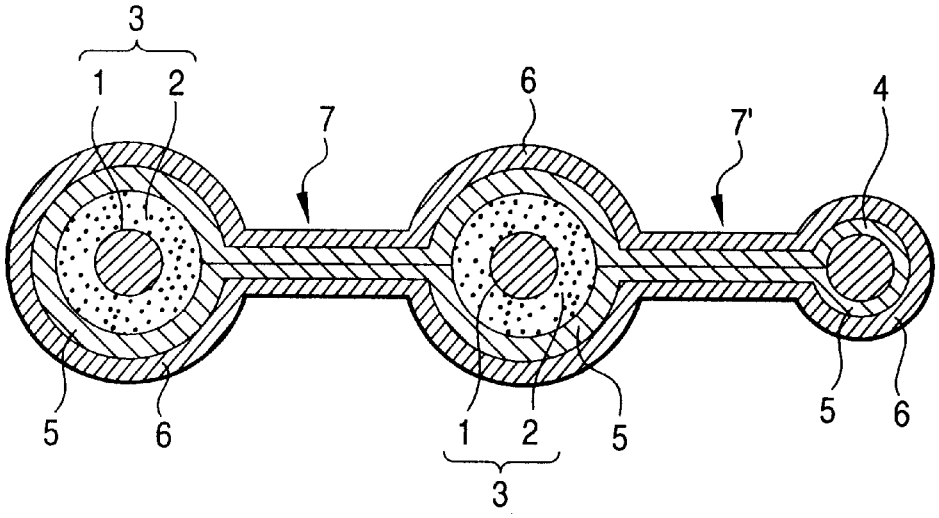
FIG. 1 is a cross sectional view showing a structure of the shielding wire of flat cable type to be applied with the shielding tape.

First, an embodiment of the shielding tape of the present invention is described referring to FIG. 1.

The shielding tape of the instant embodiment is suitably used in conjunction with a flat cable type shielding wire, as shown in FIG. 1. The structure, as shown in FIG. 2, is characterized in that the adhesive force of the core adhesive agent layer 14 to the insulation shielding material is less than the adhesive force between the respective layers. That is, the adhesive fore between the core adhesive agent layer 14 and the insulation shielding material is less than the adhesive force between the core adhesive agent layer 14 and the shielding layer 11, between the shielding layer 11 and the reinforcing seat layer 12 and between the reinforcing seat layer 12 and the sheath adhesive agent layer 13.

Figure 2A:
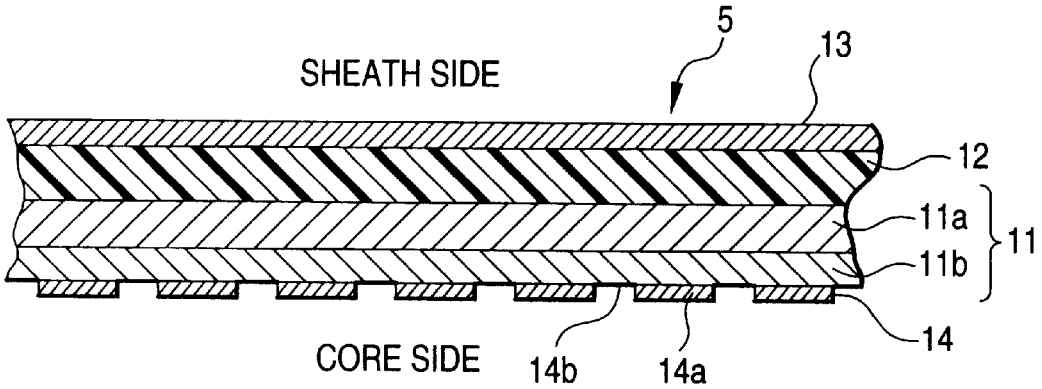
FIG. 2A is a cross sectional view for explaining the structure of the shielding tape.
Figure 2B:
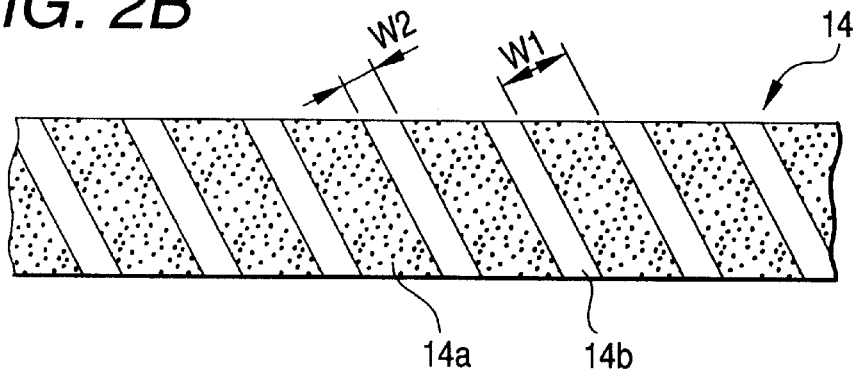
FIG. 2B is a bottom section.
Figure 3:
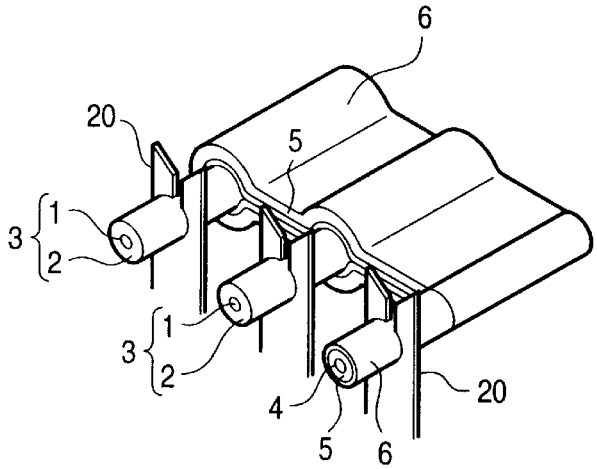
FIG. 3 is a view for explaining processing at terminals.
Figures 4A, 4B, 4C, 4D:
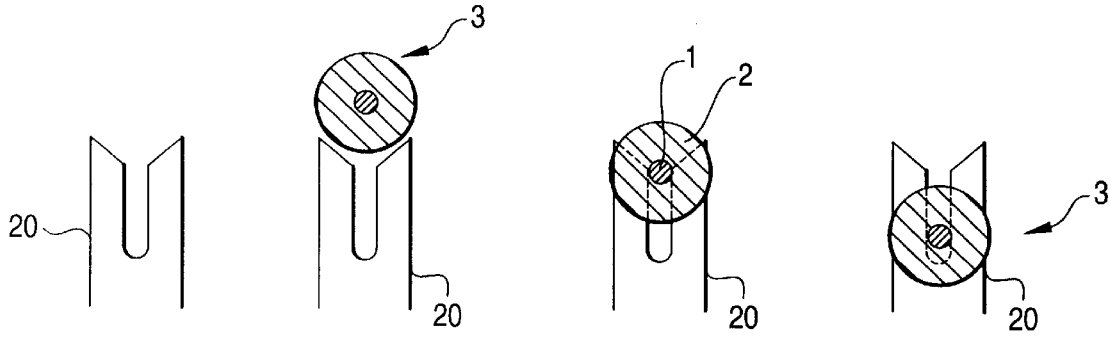
FIGS. 4A to 4D are views for explaining process at terminals.

Namely, the basic structure of the inventive shielding tape, as shown in FIG. 2A, comprises the shielding layer 11, the reinforcing seat layer 12 laminated on the side of the sheath 6 of the shielding layer 11, the sheath adhesive agent layer 13 for adhering the reinforcing seat layer 12 and the sheath, and the core adhesive agent layer 14 for adhering the shielding layer 11 and the core wire 3. The core adhesive agent layer 14 comprises a coated part 14*a* coated with the core adhesive agent and a non coated part, i.e., the part 14*b* exposing the shielding layer 11. The coated parts 14*a* and the non coated parts 14*b* are arranged alternately in oblique stripes in the lengthwise direction of the tape.

The shielding layer 11 is generally composed of a combination of a metal foil 11*a* of high electric conductivity, such as copper or aluminum, and a metal foil 11*b* of high permeability, such as iron or tin. Since the reinforcing seat layer 12 is insufficient in strength when combined only with the shielding layer 11 composed of the metal foil, the reinforcing seat layer is ordinarily laminated with a polyester seat to increase strength without substantially increasing its cost.

As long as the condition is satisfied that the adhesive force of the core adhesive agent layer 14 to the insulation shielding material is less than the adhesive force between the respective layers, the kinds of the core adhesive agent and sheath adhesive agent are not specially limited. More specifically, the core adhesive agent and the sheath adhesive agent can be selected appropriately in response to the kind of reinforcing seat, sheath material, and insulation shielding material used. However, it is preferable to select such adhesive agents so that the adhesive strength of the sheath adhesive agent to the reinforcing seat material layer 12 is greater than that of the core adhesive agent to the insulation shielding material.

Herein, the adhesive force or the adhesive strength referred to in the invention refers to an actual adhesive force or adhesive strength experienced when an exfoliation test is performed. An exemplary exfoliation test includes, for example 2 sheets of insulation shielding pieces adhered with an adhesive agent to be tested. A tensile testing machine pulls the 2 sheets in opposite directions, thereby exfoliating the sheets. The adhesive force is measured, taking the coating area into consideration, and the adhesive strength is measured by coating the adhesive agent over the entire coating area.

For selecting actual adhesive agents, a standard can be established using a solubility parameter (SP). For instance, it is sufficient to select an adhesive agent wherein a difference (|SPc−SPz|) between an SP value (SPc) of the core adhesive agent and an SP value (SPz) of an insulation shielding material is greater than a difference (|SPs SPt|) between an SP value (SPs) of a sheath adhesive agent and an SP value (SPt) of a sheath.

For example, when the insulation shielding material of the core wire and the sheath material are made of polyvinyl chloride (PS value is 9.55), it is sufficient to select the adhesive agent so that the SP value of the sheath adhesive agent is closer to the SP value of polyvinyl chloride than the SP value of the core adhesive agent.

Accordingly, when polyvinyl chloride is used as the insulation shielding material and the sheath material, vinyl chloride-vinyl acetate copolymer (SP value is 9.4 to 9.55), an adhesive agent of the polyvinyl chloride group (SP value is 9.55), an adhesive agent of the polyvinyl acetate group (SP value is 9.4), polymethylmethacrylate(SP value is 9.4) or polyethylacrylate (SP value is 9.7) can be used as the sheath adhesive agent. Among the above suitable agents, vinyl chloride-vinyl acetate copolymer is preferred because it is less costly than the others. Further, as the adhesive agent, other than the adhesive agent of polyethyleneterephthalate group, an adhesive agent of polymethacrylonitrile group (SP value is 10.6), the adhesive agent of polypropylacrylate (SP value is 9.0) and the adhesive agent of polybutylmethacrylate (SP value is 9.0) can be used. Among them, the adhesive agent of the PET group is preferred.

Further, it is preferable that the adhesive strength of the sheath adhesive agent to the reinforcing seat layer 12 be greater than the adhesive strength of the core adhesive agent to the insulation shielding material. When a seat of PET is used as the reinforcing seat layer 12, the sheath adhesive agent is preferably selected so that the difference between the SP value of the seat adhesive agent and the SP value of PET is less than the difference (|SPc−SPz|) between the SP value (SPc) of the core adhesive agent and the SP value (SPz) of the insulation shielding material.

Figure 5A:
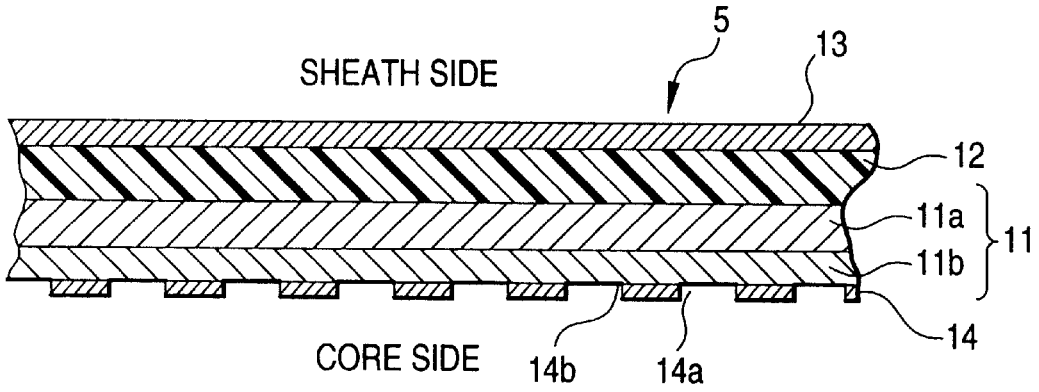
FIG. 5A is a cross sectional view showing a structure of another embodiment of the shielding tape.
Figure 5B:
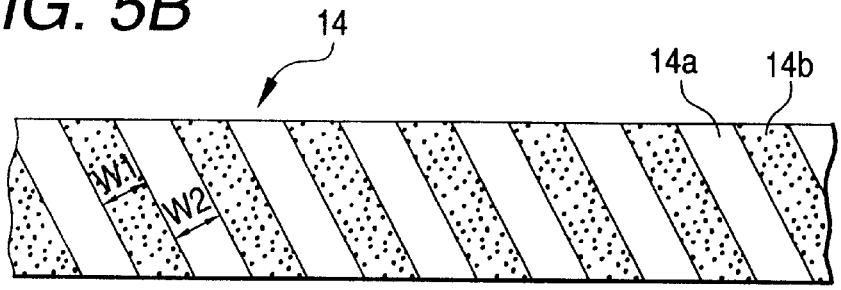
FIG. 5B is a bottom section.

For ensuring the close adherence of the core wire and the shielding tape, and in order to prevent misregistration or slipping out of the core wire, it is preferable to select an area ratio of the coating part 14*a* and the non coating part 14*b* in the core adhesive agent layer 14 within range of 1:2 to 2:1. In addition, when there is a need for superior shielding characteristics, as is needed in shielding wires for automobiles, preferably as shown in FIG. 5, the width W1 of the coating part 14*a* and the width W2 of the non coating part 14*b* are made equal. This is done because, the larger the area of the non coating part 14*b* is, the larger the area is where the non coating part 14*b* (that is, an exposed part of the shielding layer 11) contacts the drain wire. As a result, the shielding effect of electromagnetic noises can be heightened by using the adhesive force to prevent misregistration and slipping out of the core wire.

The width W1 of the coating part 14*a* (the width W2 of the non coating part 14*b*) is 1 to 2 mm, preferably 1.3 to 1.7 mm, most preferably around 1.5 mm. If the width of the coating part 14*a* is more than 2 mm, the number of the coating parts 14*a* per length of the tape is reduced, resulting in a decrease in adhesive force. On the other hand, it is not preferable that the width W1 be made narrower than 1 mm so that the number of coating parts 14*a* per length of tape is increased. Also, there may be cases when under high temperature circumstances or during pressing at high temperature, the coating part 14*a* melts and flows into the non coating part 14*b*. In this case, if the length W2 of the non coating part is narrower than 1 mm, the melted coating part goes from a next non coating part into a coating part. In such cases, the contacting area of the non-coating part 14*b* and the drain wire is reduced, resulting in a decrease in the ability to shield electromagnetic noises.

In a conventional shielding tape, when the length W1 of the coating part 14*a* and the width W2 of the non coating part 14*b* are equal, the area of the coating part 14*a* is reduced, and consequently, the adhesive force is reduced causing the core wire to be misregistered or to slip out. But, in the shielding tape of the present invention, such problems do not occur for the following reasons. Namely, in the present invention the adhesive force between the core adhesive agent layer and the insulation shielding material is less than the adhesive force exerted between the core adhesive agent layer 14 and the shielding layer 11. As a result, the adhesive force of the mutual coating parts 14*a* of the core adhesive agent in the bridge parts of the shielding wire and the adhesive force of the non coating part 14*b* exposing the shielding layer 11 are greater than the adhesive force of the core adhesive layer 14 and the core wire. Because the position of the core wire is stably fixed when processing the terminal. By setting the width W1 of the coating part 14*a* within the above range, the number of coating parts 14*a* per a unit length of tape is increased, as compared to the number of coating parts per unit length of conventional shielding tapes. As a result, the shielding tape of the present invention is able to ensure adherence with the core wire.

As long as the above requirements are satisfied in the inventive shielding tape, there are no specific limitations on the type of the reinforcing seat materials used, the type of metal used to make the shielding layers or the specific method used to laminate the shielding layers. Moreover, although not preferred, the scope of the present invention also encompasses shielding tapes comprising reinforcing layers that are not laminated.

An exemplary embodiment of a shielding wire of the present invention is depicted in FIG. 1. As depicted in FIG. 1, the shielding wire of the present invention is a flat cable type wire that includes the above-described shielding tape of the present invention.

When using the shielding wire of the present invention, the shielding tape 5 is scaled off together with the sheath 6 during exfoliation of the sheath 6 while processing the terminal and the shielding tape 5. This is possible because the adhesive force is weakest between the core adhesive agent layer 14 and the core wire. On the other hand, because the core adhesive agent layers are mutually and integrally combined, as in conventional adhesive agent layers, the core 3 does not suffer from slipping out or misregistration. In short, the exfoliation process in the present invention can be carried out by keeping both the pitch between the core wires 3 and the pitch between the core wire 3 and the drain wire 4 fixed.

Thus, in the flat c able typed shielding wire of the present invent ion equipped with the shielding tape of the present invention, the sheath 6 and the shielding tape 5 can be scaled off while maintaining the pitch between the core wires 3, 3 and the pitch between the core wire 3 and the drain wire 4. As a result, exfoliation can be achieved so that no shielding tape 5 remains on the insulation shielding material 2 of the core wire 3. Thus, the present invention makes it possible to substantially reduce the number of poor products produced by automatic processing and pressure connecting systems.

Figure 6:
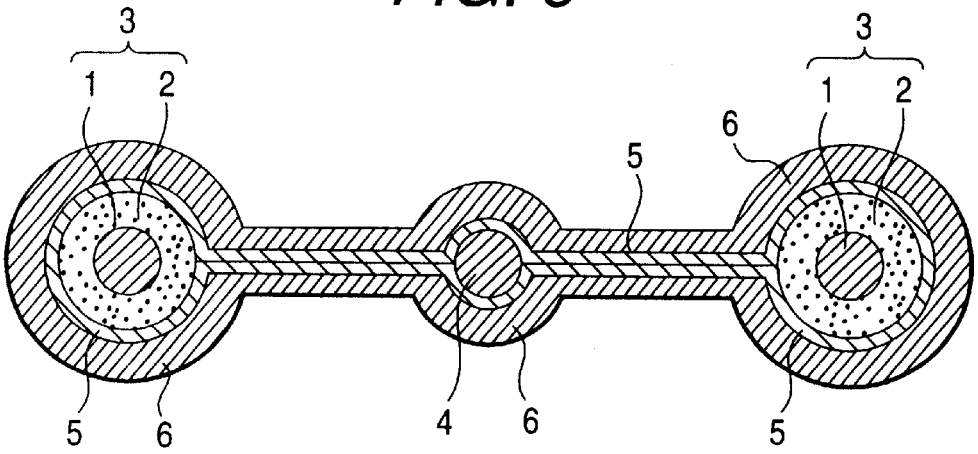
FIG. 6 is a cross sectional view showing a structure of another embodiment of the shielding wire of flat cable type to be applied with the shielding tape.

The structure of the inventive shielding wire is not limited to the structure of FIG. 1. In the present invention, flat cable type shielding wires, i.e., a plurality of core wires, are arranged in parallel at fixed distances, and are adhered and shielded in a bundle, so that the shielding tapes can maintain th e fixed distances. Thus, the shielding tape can be applied all over the shielding wires in order to provide shielding. For example, the position of the drain wire relative to the core wire is not especially limited. However, as shown in FIG. 6, the drain wire may be positioned between the core wires 3, 3. In an effort to avoid unnecessary detail, elements of the embodiment of FIG. 6 bearing the same reference numbers as the embodiment depicted in FIG. 1 are not described again, because they have already been adequately described above.

In order to ground the shielding tape, it is sufficient to arrange the flat cable type shielding wire and the drain wire so that the wires are not in parallel. In addition, the present invention is not limited to including only 2 core wires, but instead, can include a flat cable type shielding wire having a plurality of core wires.

Although the shielding tape of the present invention is suitable for use with a flat cable type shielding wire, the shielding tape of the present invention may also be used in conjunction with other types of shielding wires.

EXAMPLE

Production of the Shielding Tape and the Flat Cable Typed Shielding Wire

In the shielding tape shown in FIG. 5, an agent of the polyethyleneterephthalate group was used as the core adhesive agent, and the adhesive agent of vinyl chloride-vinyl acetate copolymer was used as the sheath adhesive agent. The width of the coating parts and the non-coating parts in the core adhesive agent layer were both equal to 1.5 mm (i.e., W1=W2=1.5 mm). In addition, a PET seat was used as the reinforcing seat layer 12, and was adhered to a copper foil using a PET adhesive agent. The copper foil was vapor-deposited with tin to produce a shielding layer 11 composed of the copper layer and the tin layer.

The shielding tape having the above-described structure was used to produce the flat cable typed shielding wire, as shown in FIG. 1. The insulation shielding material 2 and sheath was composed of polyvinyl chloride.

Observation and Consideration of the Adhesive Force and the Adhesive Strength The strength of the adhesive force between the sheath and core adhesive agents and the polyvinyl chloride was measured. The strength of the adhesive force was measuring by adhering two sheets of polyvinyl chloride testing pieces with the respective adhesive agents, and pulling the sheets in opposite directions using a tensile testing machine and then measuring the tensile force exerted as the two sheets were scaled off. The strength of the adhesive force of the sheath adhesive agent (vinyl chloride-vinyl acetate copolymer group) to the polyvinyl chloride was about 170 g, and the strength of the adhesive force of the core adhesive agent (PET group) to the polyvinyl chloride was about 120 g.

The SP value of the adhesive agent of the polyethylene terephthalate group was 10.6, and the SP value of the vinyl chloride-vinyl acetate copolymer ranged from 9.4 to 9.55, depending on the ratio of the contents of the respective monomers. Also, the SP value of polyvinyl chloride was 9.55. The relation of the respective SP values to each other to obtain the objectives of the present invention are described below.

The difference between the SP value of the core adhesive agent (SPc) and the SP value of the insulation shielding material (SPz) is as follows:

$$|SPc-SPz|=1.05 \text{ to } 1.2.$$

The difference between the SP value of the sheath adhesive agent (SPs) and the SP value of the sheath is as follows:

$$|SPs-SPt|=0 \text{ to } 0.15.$$

The difference between the SP value of the reinforcing seat (SPh) and the SP value of the sheath adhesive agent (SPs) is as follows:

$$|SPh-SPs|=1.05 \text{ to } 1.2.$$

Herein, because the reinforcing seat adhesive agent and the core adhesive agent are composed of a PET group, the difference (|SPc−SPz|) between the SP value of the core adhesive agent and the SP value of the insulation shielding material is equal to the difference (|SPh-SPs|) between the SP value of the reinforcing seat and the SP value of the sheath adhesive agent. But, the coating area of the core adhesive agent is 40 to 50%, while the sheath adhesive agent is coated all over the reinforcing seal layer. As a result, the adhesive force between the sheath adhesive agent and the reinforcing seat is greater than the adhesive force between the core adhesive agent and the insulation shielding material. Accordingly, this relationship satisfies the requirement of the invention that the adhesive force between the core adhesive agent and the insulation shielding material is less than the adhesive force between the respective layers in the shielding tape.

The Processing of the Terminals of the Shielding Wire

During automatic processing of the shielding wire at the terminals using a pressing system, the shielding tape was completely scaled off together with the sheath. Thus, the resulting product was completely free of unwanted shielding tape, that can often remain on conventional shielding wires after scaling.

The Shielding Property

Figure 7:
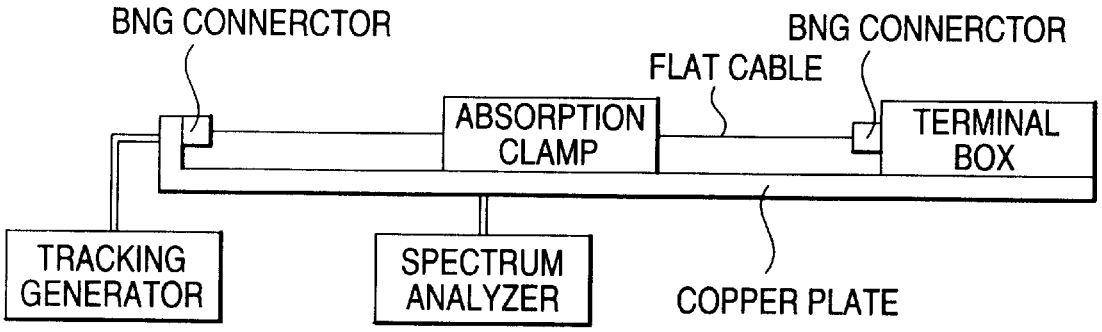
FIG. 7 is a view for explaining the measuring method of the shielding property of the shielding wire.

The shielding properties of the above shielded flat cable against electromagnetic noises were measured by an adsorption clamp method as shown in FIG. 7.

In the measuring apparatus shown in FIG. 7, both ends of the shielded flat cable were connected to BNG connectors. Electric current was sent to the core wire of the shielded flat cable, and electromagnetic noise radiated from the core wire was detected by the adsorption clamp and analyzed by a spectrum analyzer. When an increase in electromagnetic noise was detected at the core wire, the electromagnetic noise measured was −45 dB. This measurement indicated that the shielding properties of the shielded wire of the present invention, are sufficient to allow the wire to be used as a shielding wire for automobiles.

In addition, when a similar shielded wire was produced in accordance with the present invention using the shielding tape having a coating width of 1 mm and a non-coating width of 2 mm, the shielding property was measured to be −35 dB. Thus, because automobile shielding wires require a shielding property of −40 dB or more, the above shielding wire cannot be used for automobiles.

According to the invention, the terminal of the shielding wire can be processed by exfoliating the shielding tape that is securely adhered close to the core wire without causing the core wire to slip out or to be misregistered and without leaving any shielding tape remaining at the outer periphery of the core wire.

Therefore, flat cable typed shielding wires using the shielding tape of the present invention, cause fewer inferior products to be produced through automatic processing of wire terminals using a pressure connection system than are produced using shielding wires of the prior art.

Further, by using shielding tape wherein the width of the coating part and the width of the non coating part of the adhesive agent are equal in the core adhesive agent layer, the shielding tape of the present invention can provide excellent shielding against magnetic noises. The shielding property of the shielding tape of present invention is even great enough to make the tape suitable to shield shielding wires for automobiles.

Second Embodiment

The shielding wire is constructed, as shown in FIG. 1, so that core wires 3, 3 are formed integrally by wrapping the conductors 1 with insulating materials 2 and a drain wire 4 in parallel with fixed distances. A shielding tape 5 closely covers outer surfaces of the core wires 3, 3 and the drain wire 4. In addition, the shielding tape 5 is shielded on its surface with a sheath 6. The distances between the core wires 3, 3 and between the core wire 3 and the drain wire 4 are maintained by sticking mutual sheath adhesive layers 13 of the shielding tape 5 to form bridges 7, 7'.

In the current structure, the insulating material 2 of the sheath 6 and the core wire 3 is composed of a non-halogen material, that is, a polymer that does not contain halogen.

Suitable polymers include homopolymers of olefins having a relatively simple structure such as ethylene, propylene, buten, isoprene, penten, methylpentene, etc. In addition, suitable polymers for the present invention can also include copolymers of the above polymers including, copolymers of the vinyl acetate group of ethylene-vinyl acetate copolymer, etc., copolymers of the (meta)acrylate group of ethylene-ethyl (meta)acrylate copolymer, etc., ternary copolymers of ethylene-propylene- diene group, and so on. Among the above suitable polymers, polymers of the polyolefin group, such as polyethylene, polypropylene, or ethylene-propylene copolymer, are preferred because they are less costly than other suitable polymers. Among these preferred polymers polypropylene is most preferred because its has a higher melting point.

Polymers of non halogen groups can be used as materials for the sheath 6 and the insulating material 2 as they are, and if necessary, bridging formation can be provided, or heat/flame resistance can be imparted by mixing the polymers with flame retardants. Suitable non-halogen flame retardants, include metal hydroxides such as, for example, magnesium hydroxide, aluminum hydroxide, or calcium hydroxide.

Generally, the shielding tape 5, has the structure shown in FIG. 2. Namely, the shielding tape 5 comprises a shielding layer 11, a reinforcing seat layer 12 laminated on the side of a sheath 6 of the shielding layer 11, a sheath adhesive agent layer 13 for adhering the reinforcing seat layer 12 and the sheath 6, and a core adhesive agent layer 14 for adhering the shielding layer 11 and the core wire 3. The core adhesive agent layer 14 is formed by partially coating the core adhesive agent, such as in oblique strains. In addition, it is sufficient that areas for coating the core adhesive agent are selected within ranges sufficient to ensure that the core wire and the shield tape adhere to each other to prevent misregistration or slipping out of the core wire. Actually, an area ratio of the core adhesive agent and the metal foil composing the shielding layer (the adhesive agent:the metal foil) is around 1:2 to 2:1.

In the shielding tape 5 having such a structure, the adhesive agent is selected such that the adhesive force of the sheath adhesive agent layer 13 to the sheath is greater than the adhesive force of the core adhesive agent layer to the insulting material 14. Further, it is preferable that the adhesive force of the sheath adhesive agent layer 13 to the reinforcing seat layer 12 is greater than the adhesive force of the core wire of the core adhesive agent layer 14 to the insulation shielding material.

A non-halogen material satisfying the requirement of the present invention does not necessarily limit the types of the core adhesive agents and sheath adhesive agents. In particular, these adhesive agents can be selected depending on the type of the reinforcing seat, sheath material, or insulation shielding material used. As the sheath adhesive agent, adhesive agents of the polyolefin group, such as the adhesive agents of polypropylen, are preferred. Also, as the core adhesive agent, adhesive agents from the PET group are preferred.

As used herein, the term "adhesive force" refers to the adhesive force measured when an exfoliation test is performed. In an exfoliation test 2 sheets of insulation shielding test pieces are adhered with an adhesive agent to be evaluated. A tensile testing machine pulls the 2 sheets in opposite directions and exfoliates the sheets. For selecting actual adhesive agents, a standard can be set up using the solubility parameter (SP). For instance, it is sufficient to select the adhesive agent such that a difference ($|SPc-SPz|$) between an SP value (SPc) of the core adhesive agent and an SP value (SPz) of an insulation shielding material is greater than a difference ($|SPs-SPt|$) between an SP value (SPs) of the sheath adhesive agent for sheath and an SP value (SPt) of the sheath. For example, when the insulation shielding material of the core wire and the sheath material are made of polyethylene or isotacticpolypropylene (PS value is 8.1 to 8.3), it is sufficient to select the adhesive agent such that the SP value of the sheath adhesive agent is closer to 8.1 to 8.3 than the SP value of the core adhesive agent.

Actually, as the sheath adhesive agent, suitable adhesive agents include adhesive agents of the polyacrylonitrile group (SP value 5.1), adhesive agents of the polybutadiene group (SP value 8.4), adhesive agents of the polyethylene group (SP value 8.1), or adhesive agents of the polymethylene group (SP value 8.1). As the core adhesive agent, in addition to adhesive agents of the reethyleneterephthalate group (SP value 10.6), other suitable adhesive agents include adhesive agents of the polyvinyl acetate group (SP value 9.4), adhesive agents of the polymethylmethacrylate group (SP value 9.4), adhesive agents of the polyethylacrylate group (SP value 9.7), adhesive agents of the polyethylmethacrylate group (SP value 9.2), adhesive agents of the methacrylonitrile group (SP value 10.6), adhesive agents of the polypropylacrylate group (SP value 9.0), adhesive agents of the polybutylmethacrylate (SP value 9.0), or adhesive agents of the polystyrene group (SP value 9.0). It is preferable to select, among the above suitable adhesive agents, an adhesive agent that exhibits a suitable thermal resistance to temperatures experienced in the manufacture and use of the present invention. When a seat of PET is used as the reinforcing seat layer 12, the sheath adhesive agent is preferably selected so that the difference between the SP value of the seat adhesive agent and the SP value of PET is less than the difference ($|SPc-SPz|$) between the SP value (SPc) of the core adhesive agent and the SP value (SPz) of the insulation shielding material.

As mentioned, the shielding wire of the present invention is composed of a non-halogen material in all of the sheath, the insulating material of the core wire, the sheath adhesive agent composing the shielding tape, the core adhesive agent, and the reinforcing seat. Therefore, even in environments wherein the temperature is as great as 80 to 120° C., such as in automobile engine compartments during driving, poisonous hydrohalogen gases will not be generated. Further, in the shielding wire of the present invention where the core and sheath adhesive agents satisfy the above mentioned relationship, the shielding tape 5 can be exfoliated together with the sheath 6 from the core wire. On the other hand, in the bridge parts 7, the mutual core adhesive agent layers 14 are unitary, so that the pitch between the core wires 3, 3 and the pitch between the core wire 3 and the drain wire 4 remain fixed.

Thus, in the flat cable typed shielding wire of the present invention, when processing the terminal thereof, the shielding tape 5 at the cut terminal and the sheath 6 can be exfoliated without causing slipping out or misregistration of the core wire 3 and without leaving shielding tape 5 on the surface of the insulating material 2 of the core wire 3. It is therefore possible to substantially reduce the occurrence of low quality products produced through automatic processing using a pressure connecting system.

In the shielding tape used in conjunction with the shielding wire of the present invention, polyester is often used for the reinforcing seat because polyester is relatively inexpensive and provides sufficient strength. However, even though polyester is a preferred material, the shielding tape of the present invention can be made using other non-halogen materials, provided that adherence with the sheath adhesive agent is not spoiled. The metal foil to be used in the shielding layer of the present invention is generally composed of a combination of a metal foil 11*a* of high electric conductivity, such as copper or aluminum, and a metal foil 11*b* of high permeability, such as iron or tin, but not limited thereto.

In the flat cable typed shielding wire of the present invention, the position of the drain wire relative to the core wire is not especially limited. For instance, as shown in FIG. 6, the drain wire can be positioned between the core wires 3, 3. Explanation for the embodiment of FIG. 6 is omitted because FIG. 6 uses the same references numbers as those used in FIG. 1.

Furthermore, in order to provide a mechanism for grounding the shielding tape of the present invention, it is sufficient to arrange the drain wire in parallel with the core wire. Also, the number of core wires in the shielding wire of the present invention is not limited to two pieces, instead, the shielding tape of the present invention can be applied to a flat cable typed shielding wire having a plurality of core wires, such as, for example, a wire of three or more pieces.

Since the shielding wire of the invention is made using a non-halogen material in the sheath and the insulating material and shielding tape, the shielding wire of the present invention does not generate poisonous gases that can cause environmental pollution during, operation or when burned after use. Thus, the shielding wire of the present invention is not harmful to the environment.

In the shielding wire of the present invention, the core adhesive agent and the sheath adhesive agent are selected so that exfoliation can be performed by securing the adherence between the sheath, the shielding tape and the core wire so that slipping out or misregistration of the core wire are prevented. It is therefore possible to reduce the number of poor quality products generally produced by conventional automatic processing using pressure connecting systems.

What is claimed is:

1. A shielding tape comprising:

a shielding layer;

a core adhesive layer laminated on one side of said shielding layer, which adheres an insulation shielding material of a core wire;

a reinforcing seat layer laminated on another side of said shielding layer; and a sheath adhesive layer for adhering a sheath on said reinforcing seat layer;

wherein an adhesive force between said core adhesive layer and the insulation shielding material is less than adhesive forces between other layers of said wire.

2. The shielding tape as set forth in claim 1, wherein the core adhesive agent layer comprises coating areas and non-coating areas of core adhesive agent, and wherein an adhesive strength of the core adhesive agent to be applied to the coating part to the insulation shielding material is less than an adhesive strength of a sheath adhesive agent to be applied to the sheath adhesive agent layer to the sheath.

3. The shielding tape as set forth in claim 1, wherein the adhesive strength of the sheath adhesive agent to the reinforcing seat layer is greater than the adhesive strength of the core adhesive agent to the insulation shielding material.

4. The shielding tape as set forth in claim 2, wherein the core adhesive agent is a polyethylene terephthalate adhesive agent and the sheath adhesive agent is a vinyl-chloride acetate copolymer adhesive agent.

5. The shielding tape as set forth in claim 2, wherein the coating areas and the non coating areas are disposed alternately in a lengthwise direction of the tape, and the width of the coating areas and the non coating areas are equal.

6. The shielding tape as set forth in claim 5, wherein the width of the coating areas is 1 to 2 mm.

7. The shielding tape as set forth in claim 1, wherein the shielding tape is interposed in parallel between a plurality of core wires in a flat cable type shielding wire; and wherein the shielding tape is disposed at fixed distances with respect to the core wires and wherein the sheath wraps the core wires into a bundle.

8. A shielding wire of flat cable type, in which a plurality of core wires are disposed in parallel at fixed distances, said shielding wire comprising a shielding tape comprising:

a shielding layer;

a core adhesive layer laminated on one side of said shielding layer, which adheres an insulation shielding material of said core wire;

a reinforcing seat layer laminated on another side of said shielding layer; and a sheath adhesive layer for adhering a sheath on said reinforcing seat layer;

wherein an adhesive force of said core adhesive layer to the insulation shielding material is less than adhesive forces between other layers of said tape.

9. The shielding wire as set forth in claim 8, wherein a difference ($|SPc-Spz|$) between a solubility parameter value (SPc) of the core adhesive agent and a solubility parameter value (SPz) of an insulation shielding material is greater than a difference ($|SPs-SPt|$) between a solubility parameter value (SPs) of the sheath adhesive agent and a solubility parameter value (SPt) of the sheath.

10. The shielding wire as set forth in claim 9, wherein the insulation shielding material and the sheath are comprised of polyvinyl chloride.

11. The shielding wire as claimed in claim 8, wherein the shielding materials and the sheath are composed of a non-halogen material; and wherein the adhesive agent for the core and the adhesive agent for the sheath are also composed of a non-halogen material.

12. The shielding wire as set forth in claim 11, wherein the insulating material and the sheath are composed of a polyolefin material; and wherein the adhesive agent for the sheath is also composed of a polyolefin material.

13. The shielding wire as set forth in claim 12, wherein a polyethyleneterephthalate adhesive agent is used as the adhesive agent for the core.

14. The shielding wire as set forth in claim 11, wherein the shielding wire exhibits a thermal resistance for temperatures of 120° C. or less.

* * * * *